United States Patent [19]

Ohlsson

[11] 4,153,276

[45] May 8, 1979

[54] BOOKBINDING PROCESS AND BINDING OBTAINED BY THIS PROCESS

[75] Inventor: Jarl-Erik S. I. Ohlsson, St Julien en Genevois, France

[73] Assignee: Sisenca S.A., Geneve, Switzerland

[21] Appl. No.: 841,844

[22] Filed: Oct. 13, 1977

[30] Foreign Application Priority Data

Oct. 18, 1976 [CH] Switzerland ..... 13146/76

[51] Int. Cl.[2] ..... B42C 9/00

[52] U.S. Cl. ..... 281/21 R; 11/1 AD

[58] Field of Search ..... 11/1 AD; 281/21 R

[56] References Cited

U.S. PATENT DOCUMENTS

| | | | |
|---|---|---|---|
| B 576,385 | 3/1976 | Staats et al. | 11/1 AD |
| 2,044,365 | 6/1936 | Pederson | 11/1 AD |
| 2,324,834 | 7/1943 | Gurwick | 281/21 R |
| 3,093,396 | 6/1963 | Segreto | 281/21 R |

*Primary Examiner*—Frank T. Yost

*Attorney, Agent, or Firm*—Young & Thompson

[57] ABSTRACT

The invention relates to a bookbinding process in which each page is glued by its dorsal edge, characterized by the fact that a coating consistent with the used binding glue is deposited, before folding and cutting of the signatures, along one or more areas located on both sides of the folding lines of the paper sheet for forming said signatures, that after folding and assembling several signatures the dorsal part thereof is trimmed in such a manner that the coated area emerges on the dorsal edge of the pages, and that the thus obtained assembly of pages is glued by means of an appropriate binding glue, as well as to the binding obtained by this process in which the faces of the pages comprise in a zone next to the dorsal edge thereof a layer of a coating which easily binds itself with the binding glue used.

7 Claims, 5 Drawing Figures

BOOKBINDING PROCESS AND BINDING OBTAINED BY THIS PROCESS

There is already known an excellent kind of binding according to which each separate sheet is glued by its dorsal edge against any support which can even be constituted by a layer of the glue itself. This kind of binding, which is economical and industrially utilizable, shows however some defects especially when the pages to be bound are made of a glazed paper or are covered with a surface coating having poor adhesiveness to the used glue. In this case, only the dorsal edge of the sheet is glued on the support, this being not always adequate for a good binding, the glue entering by capillarity in the area between two adjacent pages being thus useless, since said glue does not adequately stick to the treated paper surface of said pages.

The object of the present invention is to provide a book-binding process in which each page is glued by its dorsal edge, which is characterized by the fact that a coating consistent with the used binding glue is deposited, before folding and cutting of the signatures, along one or more areas located on both sides of the folding lines of the paper sheet for forming said signatures, that after folding and assembling several signatures the dorsal part thereof is trimmed in such a manner that the coated area emerges on the dorsal edge of the pages, and that the thus obtained assembly of pages is glued by means of an appropriate binding glue.

The invention has also as another object the provision of a binding obtained by the described process, which is characterized by the fact that the faces of the pages comprise in an area adjacent to the dorsal edge thereof a layer of a coating which easily binds itself with the used binding glue.

The annexed drawings illustrate schematically and by way of example two embodiments of the present process.

In order to ensure a good binding, it is necessary that the used glue adheres well not only to the dorsal edge of the pages, but also to the faces thereof in areas near their dorsal edge. This is often difficult to realize when some kinds of paper are used which are treated or the surface of which is coated with a glazing layer.

According to the present process, each page to be bound is provided with a coating in areas next to its dorsal edge, this coating presenting good adherence not only with the used paper surface but also with the used binding glue. This coating is generally constituted by an adhesive.

Figure 2:
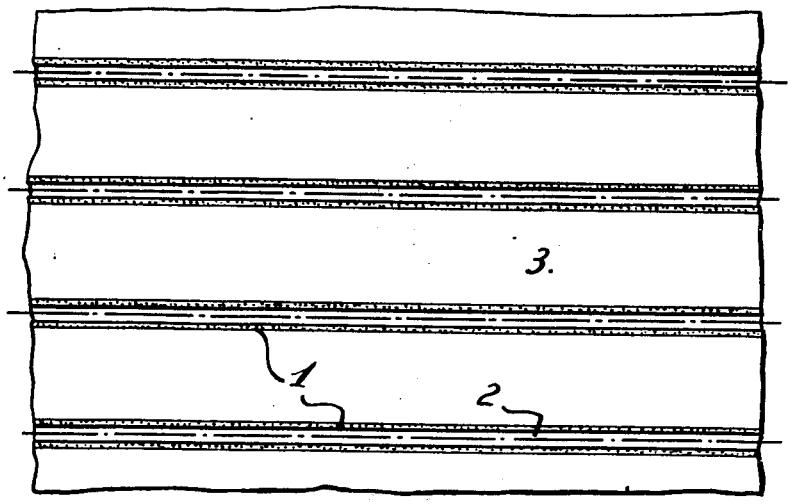
FIG. 2 illustrates the sheet of paper before folding and cutting of the gatherings.
Figure 4:
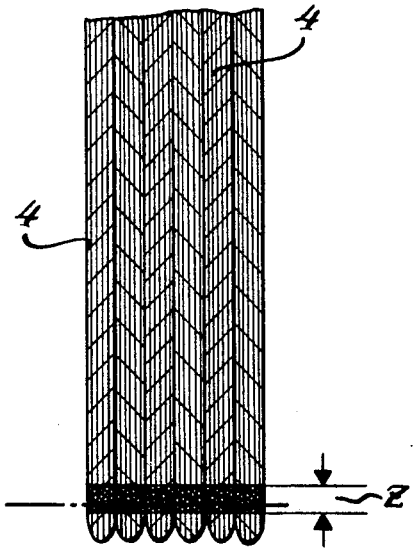
FIG. 4 illustrates the piling up of several signatures.

For ease of manufacture, this adhesive coating is applied before, during or after the printing of the paper, when the used sheet is still entire, that is before its cutting and folding into signatures. For example, rectilinear areas 1 of adhesive are continuously applied, during printing, along the sheet, on both sides of the folding lines 2 (see FIG. 2). The sheet 3 is then folded and cut so as to form a signature 4 containing a certain number of pages 5. These signatures 4 are next piled up (FIG. 3), and then cut as shown in FIG. 4. By this trimming operation, the zone Z in which the adhesive coating was applied is made flush with the dorsal part of the separate pages 5.

Finally, the thus separated and assembled pages are bound by means of glue 6 to a support (not shown) in order to obtain the finished binding.

Figure 1:
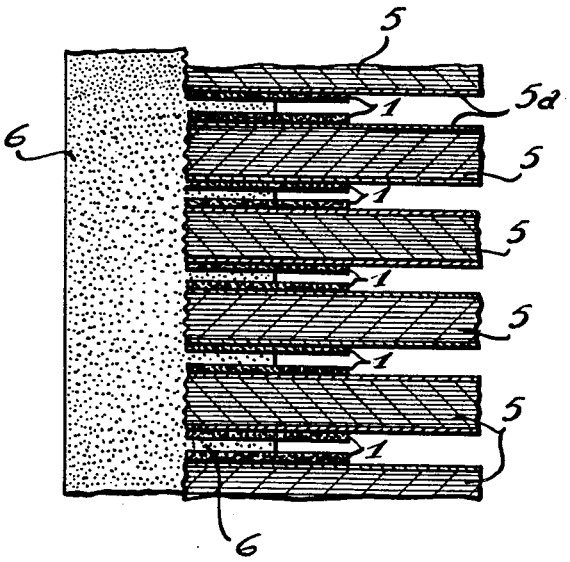
FIG. 1 is a cross-section view of a binding.

It can be clearly seen from FIG. 1 that each page 5, after its surface treatment 5*a*, is provided in its dorsal edge area with an adhesive coating 1 cooperating or effectively combining itself with glue 6 for firmly fastening each page to the support.

According to the kind of glue used, for example of the plastic type, it is not necessary to provide another support, a layer of said glue being used itself as support.

Figure 3:
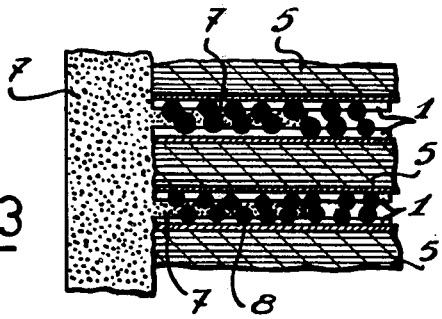
FIG. 3 is a cross-section view of another embodiment of binding.
Figure 5:
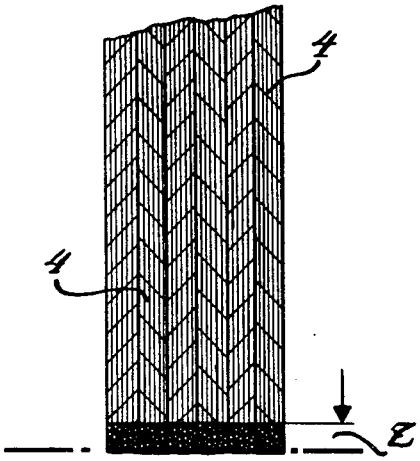
FIG. 5 illustrates the signature after trimming.

In another embodiment shown in FIG. 3, the adhesive applied to the rectilinear areas 1 contains solid particles 8, sized with a small diameter and intended for ensuring a constant spacing between the assembled pages 5, as well as a better penetration of the glue 7.

It is obvious that the application of the adhesive coating onto the sheet of paper can be realized before, during or after the printing thereof, however always before cutting and folding thereof to form signatures.

I claim:

1. A bookbinding process comprising applying adhesive along both sides of the folding lines of paper sheets, cutting, folding and assembling the sheets to form signatures, assembling a plurality of said signatures and trimming the dorsal part thereof so that the coated areas emerge on the dorsal edges of the pages, and gluing the thus-obtained assembly of signatures along said dorsal edges with bookbinding glue.

2. A process as claimed in claim 1, in which each coating area is applied so as to overlap a folding line of the sheet.

3. A process as claimed in claim 1, in which each folding line of the sheet is bordered by two spaced coating areas.

4. A process as claimed in claim 1, in which the coating areas are rectilinear.

5. A process as claimed in claim 1, and gluing said pages to a support with said bookbinding glue.

6. A process as claimed in claim 1, and incorporating solid particles in said adhesive.

7. A binding made by the process of claim 1, comprising a plurality of pages whose dorsal edges are coated on opposite sides thereof with an adhesive, and a quantity of bookbinding glue securing said pages together in a book.

* * * * *